US010807386B2

(12) United States Patent
Izawa et al.

(10) Patent No.: US 10,807,386 B2
(45) Date of Patent: Oct. 20, 2020

(54) PRINTING DEVICE

(71) Applicant: MIYAKOSHI PRINTING MACHINERY CO., LTD., Narashino-shi, Chiba (JP)

(72) Inventors: Hideo Izawa, Narashino (JP); Seiji Komatsuda, Yokote (JP); Eiichi Tamura, Yokote (JP)

(73) Assignee: MIYAKOSHI PRINTING MACHINERY CO., LTD., Narashino-Shi, Chiba (JP)

( * ) Notice: Subject to any disclaimer, the term of this patent is extended or adjusted under 35 U.S.C. 154(b) by 0 days.

(21) Appl. No.: 16/422,053

(22) Filed: May 24, 2019

(65) Prior Publication Data

US 2020/0254783 A1 Aug. 13, 2020

(30) Foreign Application Priority Data

Feb. 13, 2019 (JP) ..... 2019-023890

(51) Int. Cl.
*B41J 29/38* (2006.01)
*B41J 11/00* (2006.01)

(52) U.S. Cl.
CPC ..... *B41J 11/002* (2013.01)

(58) Field of Classification Search
CPC ..... B41J 11/002
USPC ..... 347/14; 219/486
See application file for complete search history.

(56) References Cited

U.S. PATENT DOCUMENTS

| | | | | |
|---|---|---|---|---|
| 4,138,607 | A | 2/1979 | Engelmann | |
| 8,820,881 | B2 | 9/2014 | Wada | |
| 9,248,666 | B2 | 2/2016 | Fuchioka et al. | |
| 2011/0267393 | A1* | 11/2011 | Okamoto | B41J 11/002 347/14 |
| 2015/0215992 | A1* | 7/2015 | Lopez Rodriguez | B41J 11/002 219/486 |

FOREIGN PATENT DOCUMENTS

JP 2016-107549 A 6/2016

OTHER PUBLICATIONS

European Patent Office Search Report for corresponding application No. 19175918.2, dated Dec. 12, 2019 (7 pages).

* cited by examiner

*Primary Examiner* — Lam S Nguyen
(74) *Attorney, Agent, or Firm* — Flynn Thiel, P.C.

(57) ABSTRACT

To provide a printing device that can carry out a temperature adjustment of air in a simple manner and also provide superior energy efficiency, the present invention relates to a printing device 100 that is constituted by a printing part 5, a first air heater part 6a and a second air heater part 6b, as well as a control part 4, and each of the first air heater part 6a and the second air heater part 6b is constituted by at least one or more air heaters 6, and the control part 4 carries out a first control in which the first air heater part 6a is turned ON, while the second air heater part 6b is simultaneously turned OFF and a second control in which the first air heater part 6a is turned OFF, while the second air heater part 6b is simultaneously turned ON, with the first control and the second control being alternately switched in each fixed period.

11 Claims, 13 Drawing Sheets

PRINTING DEVICE

TECHNICAL FIELD

The present invention relates to a printing device provided with a control part that ON/OFF controls heating of an air heater.

BACKGROUND ART

In the field of printing, for example, a drying process by heating is carried out by blowing heated air to a printed medium formed by subjecting a printing medium to a printing process.

At this time, in order to efficiently heating and drying the printed medium, various heating control processes are carried out on a heating device.

For example, a liquid coating device, which has a drying part for blowing air heated by a heating wire onto the surface of a printing base material, has been known (for example, see PTL 1).

In such a liquid coating device, the temperature of the air to be blown onto the printing base material by the drying part (temperature of an air outlet of the drying part) is set by a control part in accordance with heat resistant property of the printing base material.

CITATION LIST

Patent Literature

PTL 1: Japanese Patent Application Laid-Open No. 2016-107549

SUMMARY OF INVENTION

Technical Problem

However, in the liquid coating device described in PTL 1, since the temperature of air (air flow) blown by the drying part is controlled by the setting of the output value, the resulting disadvantage is that a large energy loss is caused.

In view of the above-mentioned circumstances, the present invention has been devised, and its object is to provide a printing device that can easily carry out the temperature adjustment of air more simply, and is also superior in energy efficiency.

Solution to Problems

After having extensively studied so as to solve the above-mentioned problems, the inventors of the present invention have found that by providing a control part that ON/OFF controls the heating process of an air heater part and by also allowing the control part to alternately switch between a first control and a second control, the above-mentioned problems can be solved so that the present invention has been achieved.

The present invention relates to (1) a printing device that is provided with a printing part for printing ink on a printing medium, a first air heater part and a second air heater part for heating and drying the printed medium on which the ink is printed, and a control part that ON/OFF controls heating of the first air heater part and the second air heater part, wherein each of the first air heater part and the second air heater part is constituted by at least one or more air heaters, and the control part includes a first control in which the first air heater part is turned ON, while the second air heater part is simultaneously turned OFF and a second control in which the first air heater part is turned OFF, while the second air heater part is simultaneously turned ON, with the first control and the second control being alternately switched in each fixed time.

The present invention relates to (2) the printing device described in the above-mentioned (1) in which each of the air heaters has a temperature detection part attached thereto for measuring the current temperature at the time of the first control start so that based upon a temperature difference obtained by subtracting a target temperature from the current temperature of an air heater to be set to an ON state, the control part carries out a third control in which prior to passage of a fixed period of time, the corresponding air heater is turned OFF.

The present invention relates to (3) the printing device described in the above-mentioned (2) in which, supposing that a continuous heating process for a fixed period of time is 100% duty cycle, in the case when the current temperature of an air heater to be set to an ON state in the third control is the same as the target temperature, after heating the air heater at an updated duty cycle updated to X1% duty cycle, the corresponding air heater is set to an OFF state, in the case when the current temperature of an air heater to be turned ON is higher than the target temperature, after heating the air heater at an updated duty cycle updated to X2% duty cycle, the corresponding air heater is set to the OFF state, and in the case when the current temperature of an air heater to be turned ON is lower than the target temperature, after heating the air heater at an updated duty cycle updated to X3% duty cycle, the corresponding air heater is set to the OFF state, and in this configuration, X1 is set to 20 to 30, and X1, X2 and X3 satisfy a relational expression $X2<X1<X3$.

The present invention relates to (4) printing device described in the above-mentioned (3) in which in the case when the temperature difference of the air heater to be turned ON is greater than 0° C. and less than 4° C., after heating the air heater at an updated duty cycle updated to X4% duty cycle, the corresponding air heater is set to the OFF state, and in the case when the temperature difference of the air heater to be turned ON is 4° C. or more, after heating the air heater at an updated duty cycle updated to X5% duty cycle, the corresponding air heater is set to the OFF state, and in this configuration, X1, X4 and X5 satisfy a relational expression $X5<X4<X1$.

The present invention relates to (5) the printing device described in the above-mentioned (3) or (4) in which the control part carries out a fourth control so that by allocating a distributed duty cycle corresponding to the rest of the time obtained by subtracting an update duty cycle from 100% duty cycle to the air heater in the OFF state, the corresponding air heater is heated.

The present invention relates to (6) the printing device described in the above-mentioned (5) in which in the fourth control, the distributed duty cycle is allocated to an air heater whose temperature difference is −3° C. or less.

The present invention relates to (7) the printing device described in the above-mentioned (5) or (6) in which in the fourth control, larger distributed duty cycles are allocated to air heaters in the ascending order from the air heater having the lowest current temperature.

The present invention relates to (8) the printing device described in any one of the above-mentioned (1) to (7) in which the air heater is provided with a housing part having an opening part for use in blowing air, and a nozzle part and a heater part built into the housing part, wherein the nozzle part supplies air into the housing part, and the heater part heats air inside the housing part.

Advantageous Effects of Invention

In the printing device of the present invention, since the control part ON/OFF controls the heating of the air heater part, the temperature adjustment of air can be carried out more simply.

Moreover, in the above-mentioned printing device, since the control part carries out a first control in which the first air heater part is turned ON, while the second air heater part is simultaneously turning OFF and a second control in which the first air heater part is turned OFF, while the second air heater part is simultaneously turning ON, and since the these processes are alternately switched, it is possible to provide superior energy efficiency.

Additionally, in the case when the first air heater part and the second air heater part are simultaneously turned ON and are also simultaneously turned OFF, the resulting disadvantage is that the energy load becomes extremely large when the two parts are simultaneously turned ON.

In the printing device in accordance with the present invention, based upon a temperature difference obtained by subtracting a target temperature from the current temperature of an air heater to be set to an ON state, the control part further carries out a third control in which prior to passage of a fixed period of time, the corresponding air heater is turned OFF; thus, since it becomes possible to exclude an unnecessary heating process, a further superior energy efficiency can be obtained.

At this time, in the case when the current temperature of an air heater to be set to an ON state is the same as the target temperature, the heating process is carried out at an updated duty cycle updated to X1% duty cycle, in the case when the current temperature is higher than the target temperature, after heating the air heater at an updated duty cycle updated to X2% duty cycle, the corresponding air heater is set to an OFF state, and in the case when the current temperature is lower than the target temperature, after heating the air heater at an updated duty cycle updated to X3% duty cycle, the corresponding air heater is set to the OFF state, and in this configuration, X1 is set to 20 to 30, and X1, X2 and X3 desirably satisfy a relational expression $X2<X1<X3$.

Moreover, in the case when the current temperature is higher than the target temperature, if the temperature difference of the air heater to be turned ON is higher than 0° C. and less than 4° C., after heating the air heater at an updated duty cycle updated to X4% duty cycle, the air heater is turned OFF, and if the temperature difference of the air heater to be turned ON is 4° C. or more, after heating the air heater at an updated duty cycle updated to X5% duty cycle, the air heater is turned OFF, and in this configuration, X1, X4 and X5 desirably satisfy a relational expression of $X5<X4<X1$.

In these cases, the energy efficiency becomes further superior.

In the printing device of the present invention, the control part carries out a fourth control in which by allocating a distributed duty cycle corresponding to the rest of the time obtained by subtracting an update duty cycle from 100% duty cycle to the air heater in the OFF state, the corresponding air heater is heated so that the temperature difference between the mutual air heaters can be made as small as possible.

At this time, by allocating the distributed duty cycle to the air heater whose temperature difference is −3° C. or less, a temperature overshoot of the corresponding heater can be suppressed.

Moreover, by allocating larger distributed duty cycles to air heaters in the ascending order from the air heater having the lowest current temperature, the temperature difference between mutual air heaters can be made smaller efficiently in a short period of time.

In the printing device in the present invention, in the case when the air heater is designed to have a housing part having an opening part, and a nozzle part and a heater part so that the nozzle part supplies air into the housing part, and the heater part heats air inside the housing part, the resulting advantage is that the temperature management of air can be easily carried out.

DESCRIPTION OF EMBODIMENTS

Figure 1:
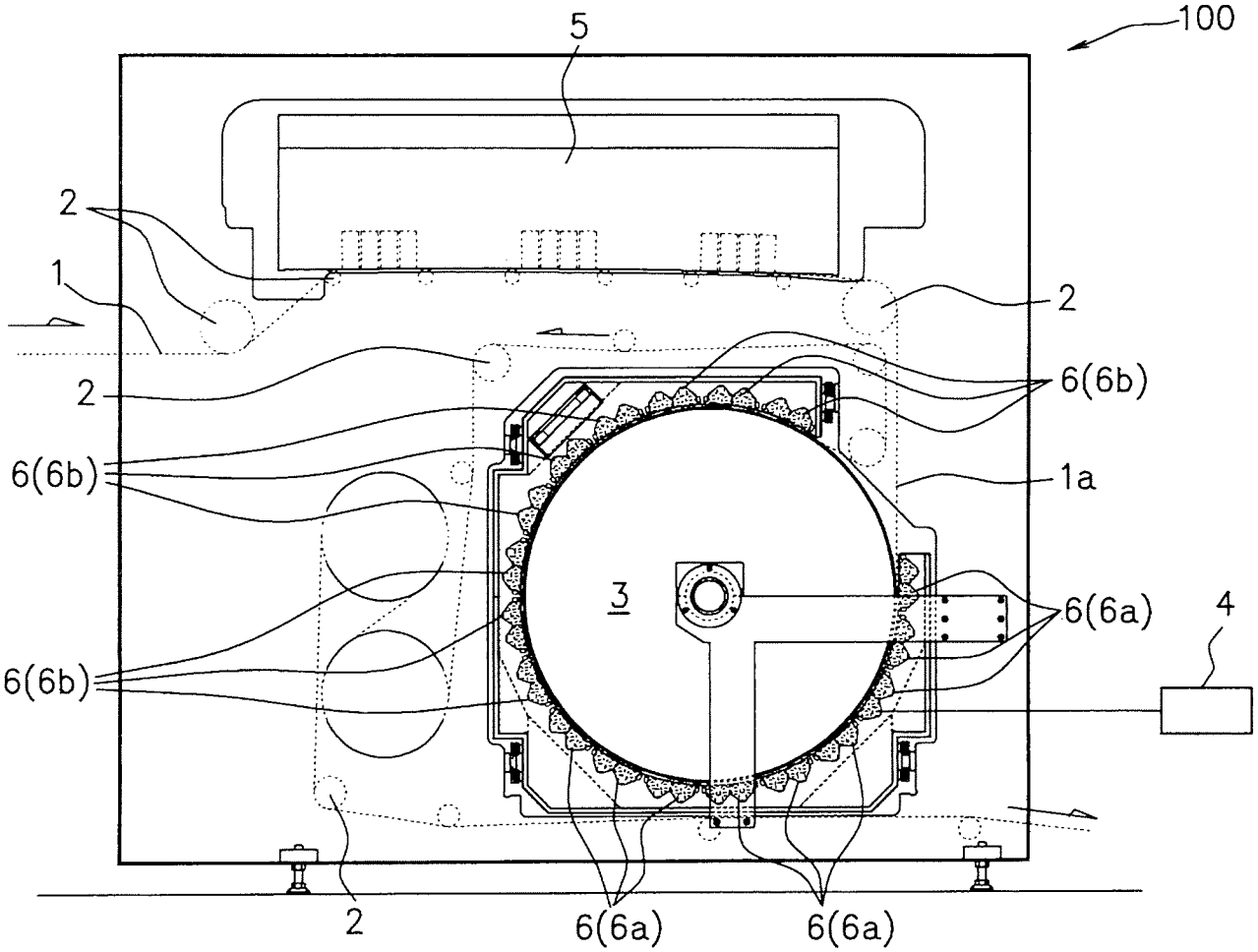
FIG. 1 is a schematic side view showing one embodiment of a printing device relating to the present invention.

Referring to Figures on demand, explanation will be given on a desired embodiment of the present invention in details. Additionally, in the Figures, the same elements are indicated by the same reference numerals, and overlapped explanation will be omitted. Moreover, the positional relationship, such as longitudinal directions, lateral directions and the like, is determined based upon the positional relationship shown in the drawing unless otherwise specified. Furthermore, the dimensional ratio of the drawing is not intended to be limited by the ratio shown in the drawing.

FIG. 1 is a schematic side view showing one embodiment of a printing device in accordance with the present invention.

As shown in FIG. 1, a printing device 100 in accordance with the present invention is prepared as an ink-jet printing device that applies ink in an ink-jet system.

The printing device 100 is constituted by a printing part 5 for printing ink onto a printing medium 1, a drum 3 around which a printed medium 1*a* with the ink printed thereon is wrapped so as to be transported, a first air heater part 6*a* and a second air heater part 6*b* which are disposed so as to be opposed to the drum 3 and each of which is constituted by a plurality of air heaters for heating and drying the printed medium 1*a*, a control part 4 capable of individually ON/OFF controlling heating processes of all the air heaters 6, and a plurality of guide rollers 2 for guiding the printing medium 1 or the printed medium 1*a*.

In this case, in the printing device 100, each of the first air heater part 6*a* and the second air heater part 6*b* is constituted by at least one or more air heaters 6. More specifically, 18 units of air heaters 6 on the upstream side are prepared as first air heater parts 6*a* and 18 units of air heaters 6 on the downstream side are prepared as second air heater parts 6*b*.

Moreover, the air heaters 6 constituting the first air heater parts 6*a* and the air heaters 6 constituting the second air heater parts 6*b* are the same heater parts. Additionally, detailed descriptions of the air heaters 6 will be given later.

In the printing device 100, as will be explained later, the control part 4 is designed to ON/OFF control heating of all the air heaters 6 (first air heater part 6*a* and second air heater 6*b*).

In this case, the ON/OFF control includes the ON control and OFF control, and the ON control is a control process for turning the air heater 6 in a stopped state to an operating state, and the OFF control is a control process for turning the air heater 6 in the operating state to the stopped state. Additionally, the control part 4 will be explained later in detail.

Thus, in the printing device 100, the temperature adjustment of air can be carried out in a simple manner.

In the printing device 100, an elongated printing medium 1 directed from a paper-feeding part, not shown, is guided by a plurality of guide rollers 2, and ink is applied thereto in the printing part 5 so that a printed medium 1*a* is formed.

Next, the printed medium 1*a* is further guided by a plurality of guide rollers 2 so as to be guided while being made in contact with the outer circumferential surface of the drum 3 in a manner so as to be wrapped therearound, and heated and dried by the air heater 6 from one of the surface sides.

In this case, guide rollers 2, each of which is constituted by a transport roller that is driven, with its rotation amount being adjusted on demand, and a guiding roller that co-rotates together therewith, are disposed on demand at such positions that a predetermined tension is maintained so as not to cause the printing medium 1 and the printed medium 1*a* to meander in a section from the inlet of the printing device 100 to the outlet of the printing device 100 by way of the drying drum.

Moreover, the drum 3 is formed into a heating drum capable of heating its surface so that the other surface side of the printed medium 1 is heated and dried by the drum 3. That is, in the printing device 100, both of the sides of the printed medium 1*a* can be simultaneously heated and dried.

Furthermore, the printed body 1*a* thus heated and dried is further guided by guide rollers 2, and collected by a collecting part, not shown.

In the printing device 100, as the printing medium 1, for example, paper, cloth, non-woven fibers, film, metal foil or the like may be adopted. Additionally, with respect to this, an ink receiving layer for receiving ink may be formed on the surface to which the ink is applied.

Moreover, as the ink, although not particularly limited, such an ink formed by including a colorant such as a dye, a pigment or the like, an aqueous solvent and a known additive applied thereto, if necessary, may be used.

Additionally, in the printing device 100, the printed medium 1*a* is formed by printing a predetermined pattern or the like on the printing medium 1 with the ink.

In the printing device 100, the printing part 5 is provided with a printing head of a line head system. That is, the printing device 100 has a system in which fixed printing heads of the printing part 5 carry out a printing process on the traveling printing medium 1. Therefore, the printing device 100 can carry out an ink-jet printing process while transporting the printing medium at high speeds.

The drum 3 has a column shape in its appearance, and is designed so that its outer circumferential surface that is made in contact with the printed medium la can be heated as described above.

In the printing device 100, the drum 3 has a hollow column shape having a hollow portion, and a band heater, not shown, is built in the hollow portion.

Thus, when the band heater heats the inner circumferential surface of the drum 3, heat is transmitted so that the outer circumferential surface of the drum 3 is also heated. Additionally, in order to prevent image quality degradation on the printed surface due to the printed medium la being rubbed and contamination on the outer circumferential surface of the drum 3, the printed medium 1*a* is guided so as to make the rear surface of its printed surface in contact with the drum 3. For this reason, the printed medium 1*a* is made in contact with the outer circumferential surface of the drum 3 so that it is heated and dried from the rear surface side of the printed surface.

In the printing device 100, the plural air heaters 6 are disposed so as to be opposed to the drum 3, with the printed medium 1*a* interposed therebetween. That is, the plural air heaters 6 are disposed in parallel with each other along the circumferential direction of the drum 3.

The air heaters 6 are designed to blow heated air toward the printed medium 1*a*. For this reason, the printed medium 1*a* is heated and dried by the air heaters 6 from the printed surface side.

Figure 2:
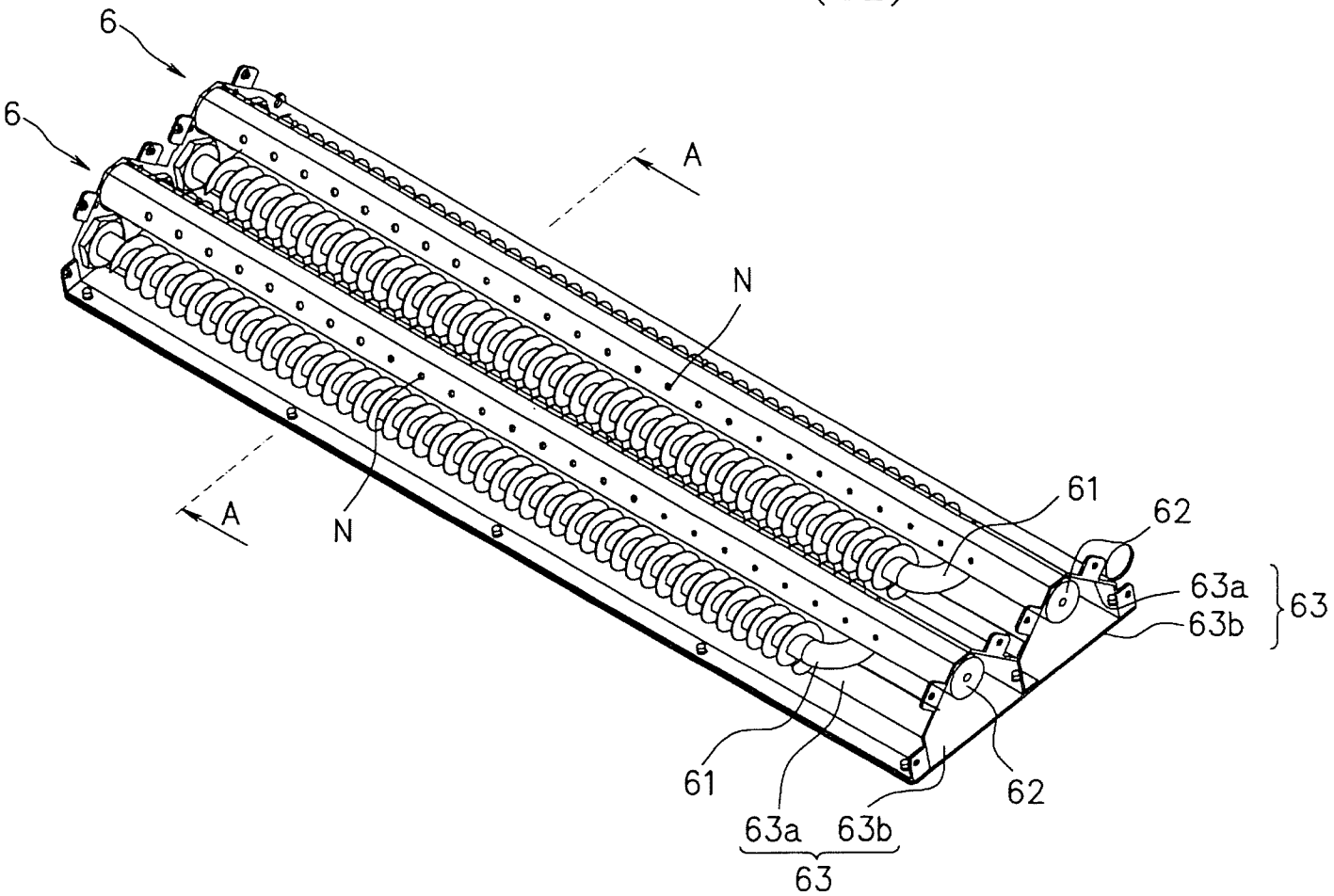
FIG. 2(A) is a transparent perspective view that shows two air heaters installed side by side in a printing device in accordance with the present embodiment.
FIG. 2(B) is a top view showing a heater part of the air heater shown in FIG. 2(A).
FIG. 2(C) is a cross-sectional view taken along a line A-A of the air heater shown in FIG. 2(A).
FIG. 2(D) is a bottom view showing the air heater shown in FIG. 2(A).
Figure 2:
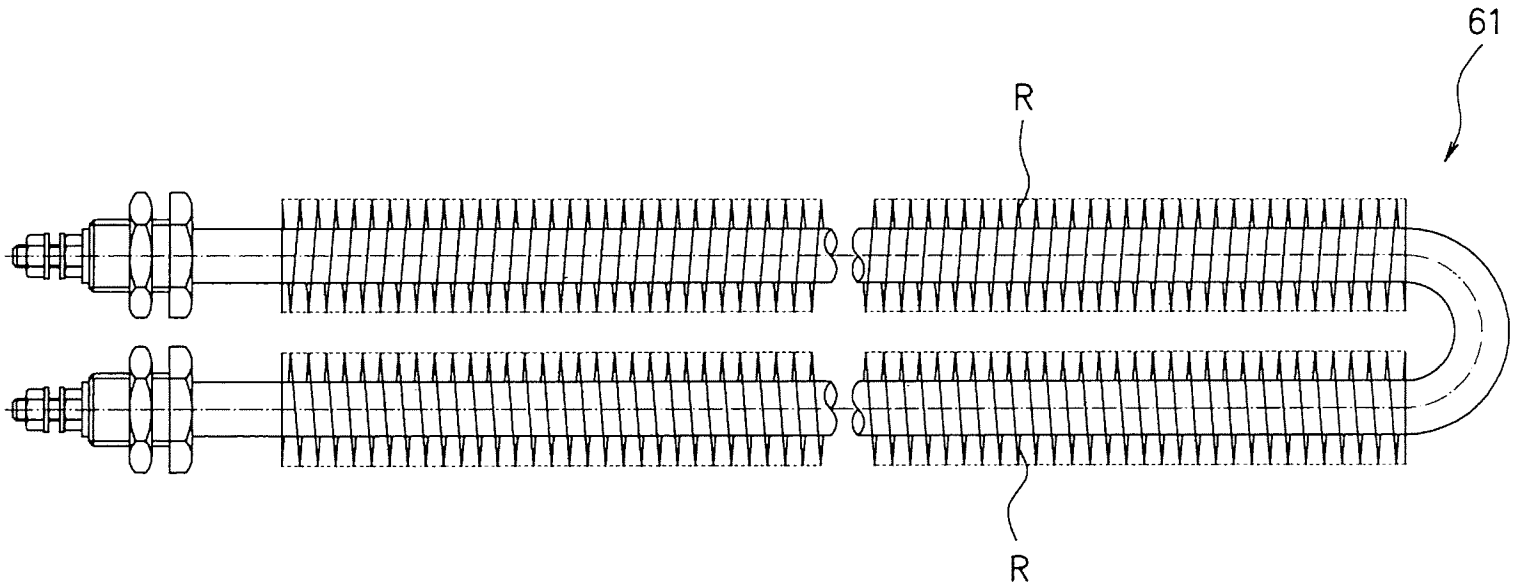
Figure 2:
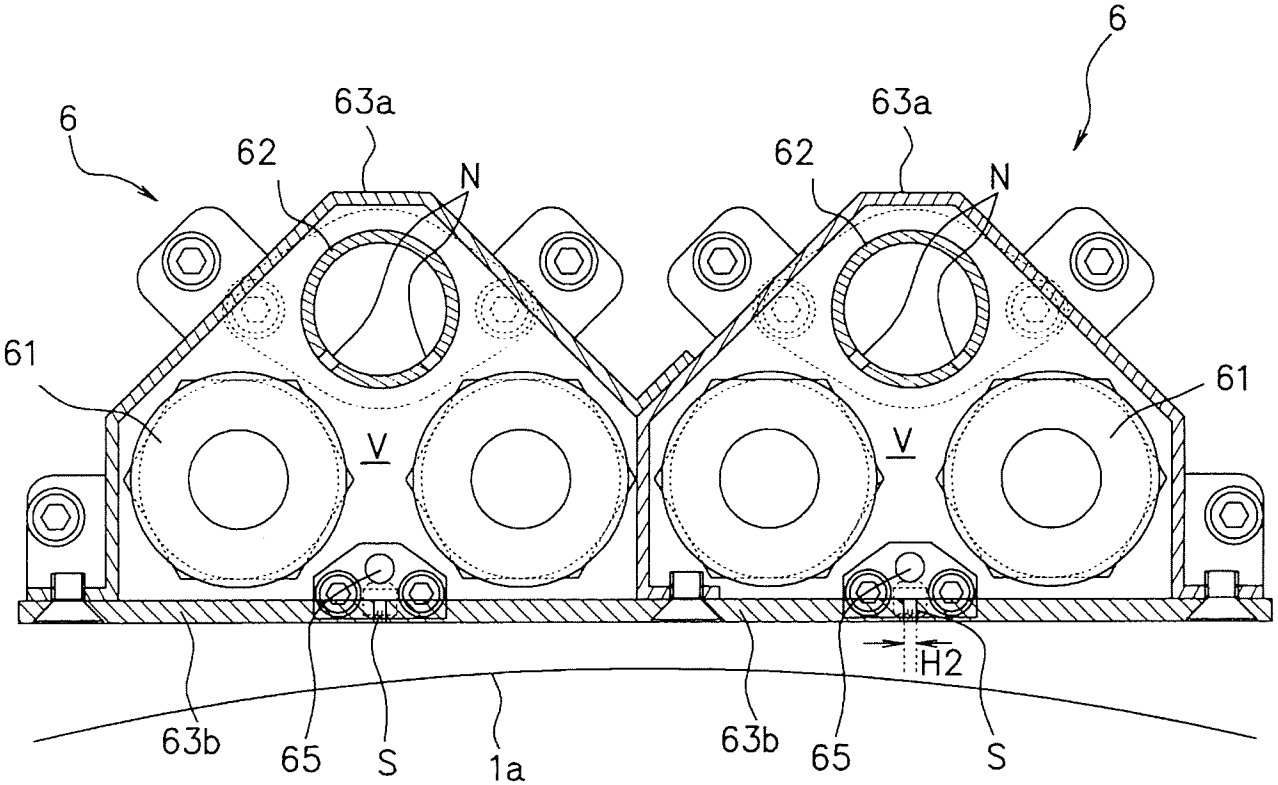
Figure 2:
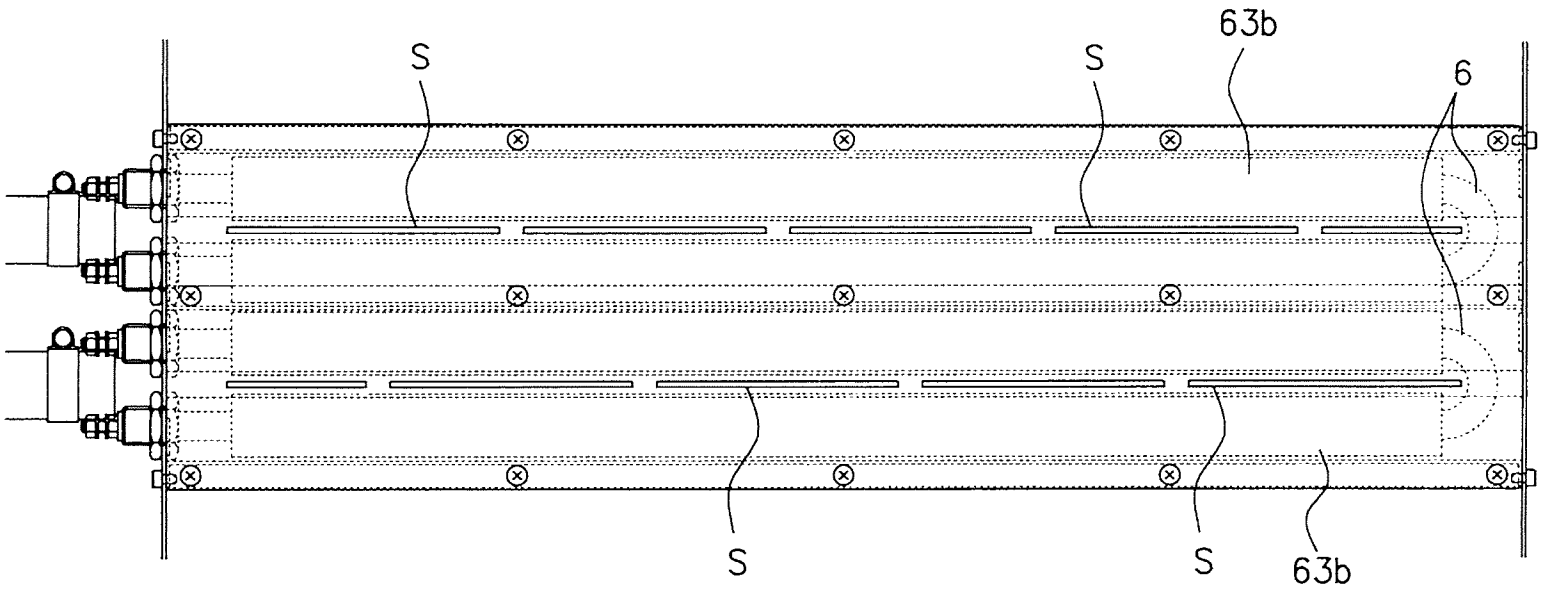

FIG. 2(A) is a transparent perspective view showing two units of air heater that are disposed side by side in the printing device in accordance with the present embodiment, FIG. 2(B) is a top view showing a heater part of the air heaters shown in FIG. 2(A), FIG. 2(C) is a cross-sectional view taken along line A-A of the air heaters shown in FIG. 2(A), and FIG. 2(D) is a bottom view showing the air heaters shown in FIG. 2(A).

As shown in FIG. 2(A), the air heaters 6 have their adjacent two-by-two units connected with each other.

Moreover, each air heater 6 has a hollow rectangular pillar shape extending in the width direction of the drum 3 in a manner so as to be substantially coincident with the width of the drum 3. Therefore, hot air to be blown from the air heater 6 extends to the entire width of the drum 3.

The air heater 6 is provided with a housing part 63 having an opening part for use in blowing air, a nozzle part 62 and a heater part 61 built in the housing part 63 and a temperature detection part 65 (see FIG. 2(C)) attached to the housing.

In the printing device 100, the housing part 63 is constituted by a bottom plate 63*b* and a heater cover 63*a* attached to the bottom plate 63*b*.

Therefore, the nozzle part 62 and the heater part 61 are disposed on the upper side of the bottom plate 63*b*, and the circumference thereof is covered with the heater cover 63*a*.

As the heater part 61, for example, a sheath heater, a drier using a heating wire or the like may be used. Additionally, the sheath heater is adopted in the printing device 100.

As shown in FIG. 2(B), the heater part 61 is bent into a U-letter shape when seen in a top view, and electrodes are installed on the ends of the two sides.

Since the heater part 61 has a heat radiating part R having a spiral shape, its surface area becomes larger. Thus, the heater part 61 makes it possible to effectively heat air inside the housing part 63.

As shown in FIG. 2(C), the heater parts 61 are disposed above the bottom plate 63*b* with a predetermined distance spaced therebetween.

Since each heater part 61 has the U-letter shape as described above, the heaters in one row are installed on each of the upstream side and the downstream side, when cut along line A-A of FIG. 2(A).

As the nozzle part 62, for example, a nozzle pipe or the like having a structure in which a plurality of openings (nozzle openings) are formed at predetermined positions on the outer circumferential surface of a stainless steel pipe or a general steel pipe may be used. Additionally, in the printing device 100, the nozzle pipe is adopted.

The nozzle part 62 is disposed above a gap between the heater parts 61 on the two sides so as to blow air toward the heater parts 61.

The nozzle part 62 is designed to allow compressed air to flow through the inside thereof, and on the lower side of the nozzle part 62, a pair of nozzle holes N are disposed toward the heater parts 61 on the two sides. Additionally, the plural nozzle holes N are formed along the length direction of the nozzle parts 62 (see FIG. 2(A)). For this reason, the nozzle part 62 is allowed to supply air into the housing part 63 through the nozzle holes N. Additionally, the supplied air is heated by the heater parts 61 as described above.

At this time, the diameter of the nozzle holes N is made to be gradually narrowed as the distance from the flow inlet of air of the nozzle part 62 becomes longer. That is, the air pressure of inflow air becomes greater at the farthest depth portion from the flow inlet of air of the nozzle part 62, and the air pressure of inflow air becomes smaller at a portion close to the flow inlet of air of the nozzle part 62; therefore, by making the diameter of the nozzle hole N smaller as it goes farther into the depth thereof, the blowing amount of air from each of the nozzle holes N can be made uniform.

As the temperature detection part 65, for example, a thermocouple, a temperature-measuring resistor or the like may be used. Additionally, in the printing device 100, the thermocouple is adopted.

The temperature detection part 65 makes it possible to measure the temperature of a space V corresponding the inside of the housing part 63 in which air heated by the heater part 61 is filled.

Moreover, the temperature detection part 65 is designed to transmit temperature information including the current temperature to be described later to the control part 4 to be described later.

As shown in FIG. 2(D), in the air heater 6, a plurality of line-shaped slits S are formed on the bottom plate 63*b* along the width direction of the drum 3 (length direction of the bottom plate 63*b*) with the same intervals.

Moreover, with respect to the two units of the air heaters 6, in the circumferential direction of the drum, the slits S on the upstream side and the slits S on the downstream side are disposed alternately so as not to be placed at the same place. Thus, the strength of the bottom plate 63*b* is suppressed from being reduced, and irregularities in the blowing range can be reduced. Additionally, in the case when the strength of the bottom plate 63*b* is sufficient, one slit that extends over the entire width direction of the drum 3 may be used.

In the air heater 6, heated air is blown over the entire width of the drum 3 from the corresponding slits S.

Additionally, the width H2 of the slits S is desirably set in a range from 0.5 mm to 1.0 mm from the points of view of the blowing width and air pressure.

Referring back to FIG. 1, the control part 4 is provided with a CPU (Central Processing Unit), a RAM (Random Access Memory), a ROM (Read Only Memory), an external storage device, an input part and an output part, and has the same structure as that of a normal computer.

In the control part 4, based upon operations of the input part, such as a mouse, a keyboard or the like, the CPU executes a control program for controlling the first air heater part 6*a* and the second air heater part 6*b*.

Additionally, such a control program is stored in an external storage device, such as a hard disc drive or the like, and the above-mentioned ROM, or the like.

In the printing device 100, based upon the above-mentioned control program, the control part 4 carries out at least, a first control, a second control, a third control and a fourth control, shown below, on the first air heater part 6*a* composed of the plural air heaters 6 on the upstream side and the second air heater part 6*b* composed of the plural air heaters 6 on the downstream side.

In this case, the first control is a control process in which the first air heater part 6*a* is turned ON, while the second air heater part 6*b* is simultaneously turned OFF and the second control is a control process in which the first air heater part 6*a* is turned OFF, while the second air heater part 6*b* is simultaneously turned ON.

Moreover, on the premise that the first control and the second control are carried out, the third control is a control process in which based upon a temperature difference obtained by subtracting a target temperature from the current temperature of an air heater to be turned ON, the corresponding air heater is turned OFF prior to the passage of a fixed period of time.

Furthermore, on the premise that the first control, the second control and the third control are carried out, a fourth control is a control process in which by allocating a distributed duty cycle corresponding to the rest of time obtained by subtracting an update duty cycle from 100% duty cycle to an air heater that is in the OFF state so that the corresponding air heater is heated.

Next, supposing that air heaters of the first air heater parts 6*a* are an air heater A1, an air heater A2 and an air heater A3 and that air heaters of the second air heater parts 6*b* are an air heater B1, an air heater B2 and an air heater B3, the respective control processes are further explained in detail.

Control of First Embodiment: In the Case of Carrying Out First Control and Second Control FIG. 3(A) is an explanatory view for explaining a case in which the first control and the second control are carried out by a control part in a printing device in accordance with the present embodiment, and FIG. 3(B) is a flow chart showing the case in which the first control and the second control are carried out by the control part in the printing device in accordance with the present embodiment.

Figure 3:
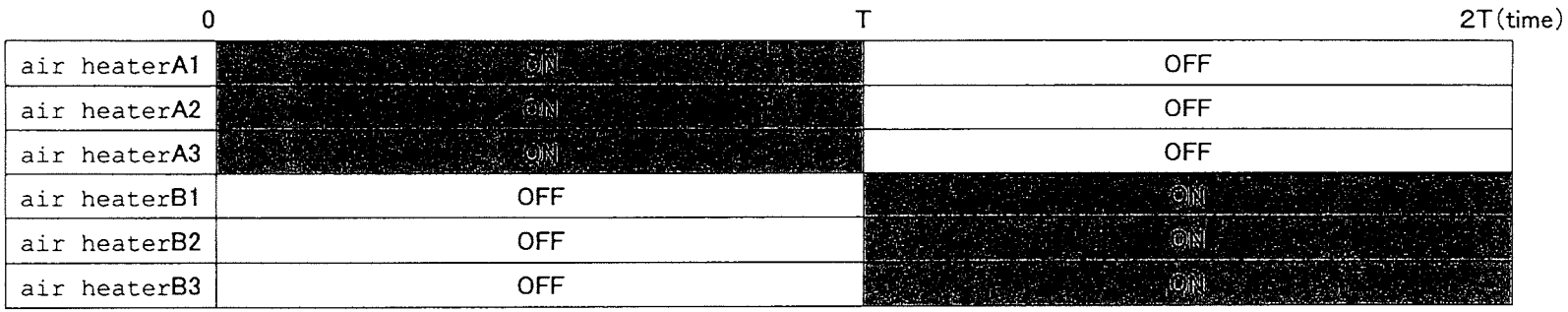
FIG. 3(A) is an explanatory view that explains a case in which a first control and a second control are carried out by a control part in a printing device in accordance with the present embodiment.
FIG. 3(B) shows a flow chart in the case when the first control and the second control are carried out by the control part in the printing device in accordance with the present embodiment.
Figure 3:
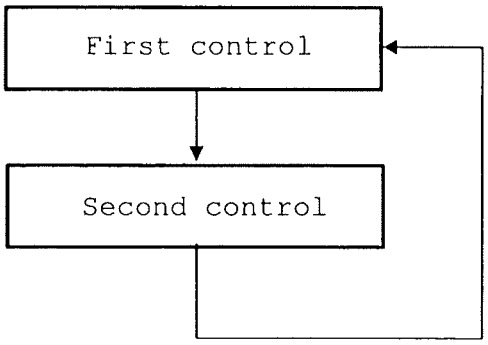

As shown in FIG. 3(A) and FIG. 3(B), in the control of the first embodiment, the first control and the second control are carried out by a control part 4 by alternately switching the first control and the second control at every fixed time T.

For example, the first control in which, with air heater A1, air heater A2 and air heater A3 kept in the ON state, air heater B1, air heater B2 and air heater B3 are brought into the OFF state is carried out, and after the passage of fixed time T in this state, the second control in which, with air heater A1, air heater A2 and air heater A3 kept in the OFF state, air heater B1, air heater B2 and air heater B3 are brought into the ON state is carried out. Additionally, the second control is carried out, and after the passage of fixed time T in this state, the first control is again carried out.

In this case, fixed time T in which the first control is carried out and fixed time T in which the second control is carried out are the same time with each other. That is, time twice as long as the fixed time T (2T) becomes one cycle.

At this time, from the viewpoints of temperature stability and efficiency, the fixed time T is desirably set in a range from 0.1 second to 3 seconds, and more desirably set in a range from 1 second to 2 seconds. Additionally, the value of fixed time T can be set by a parameter that fluctuates depending on conditions.

In this manner, in the printing device 100, the control part 4 carries out at least the first control and the second control, and since these controls are designed to be alternately switched, it also becomes possible to provide superior energy efficiency.

Control of Second Embodiment: In the Case of Carrying Out First Control, Second Control and Third Control FIG. 4(A) is an explanatory view for explaining a case in which a first control, a second control and a third control are carried out by a control part in a printing device in accordance with the present embodiment, and FIG. 4(B) is a flow chart showing a case in which the first control, the second control and the third control are carried out in a first air heater part by the control part in the printing device in accordance with the present embodiment, and FIG. 4(C) is a flow chart showing a case in which the first control, the second control and the third control are carried out in a second air heater part by the control part in the printing device in accordance with the present embodiment.

Figure 4:
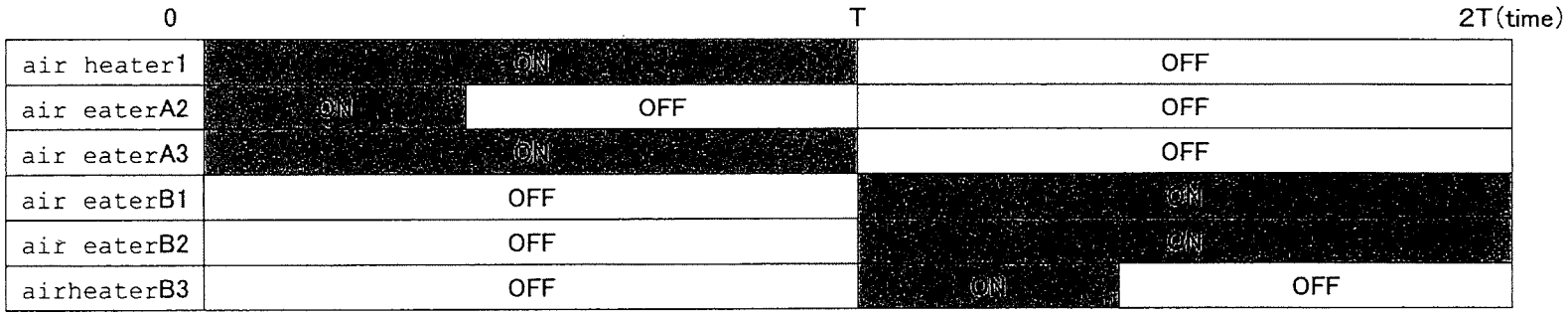
FIG. 4(A) is an explanatory view that explains a case in which the first control, the second control and a third control are carried out by the control part in the printing device in accordance with the present embodiment.
FIG. 4(B) is a flow chart in a case in which a first control, a second control and a third control of a first air heater part are carried out by the control part in the printing device in accordance with the present embodiment.
FIG. 4(C) is a flow chart in a case in which a first control, a second control and a third control of a second air heater part are carried out by the control part in the printing device in accordance with the present embodiment.
Figure 4:
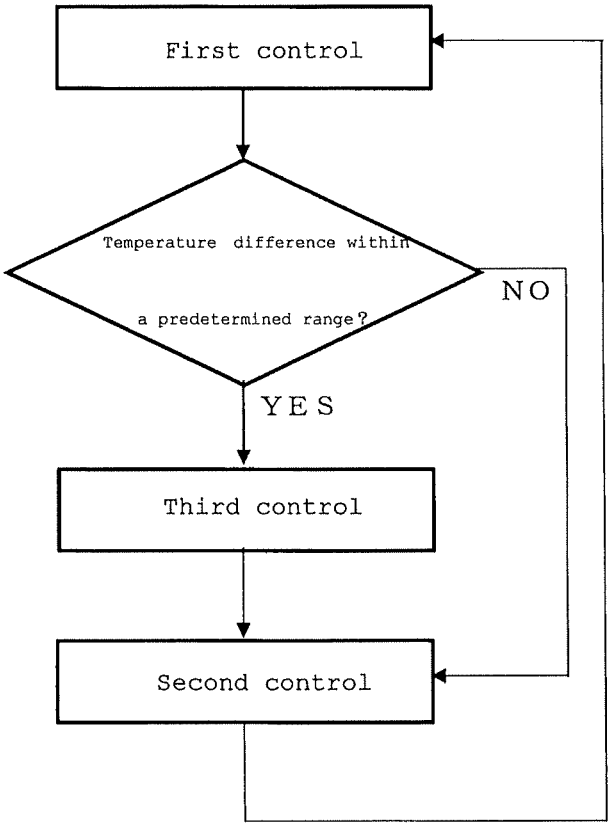
Figure 4:
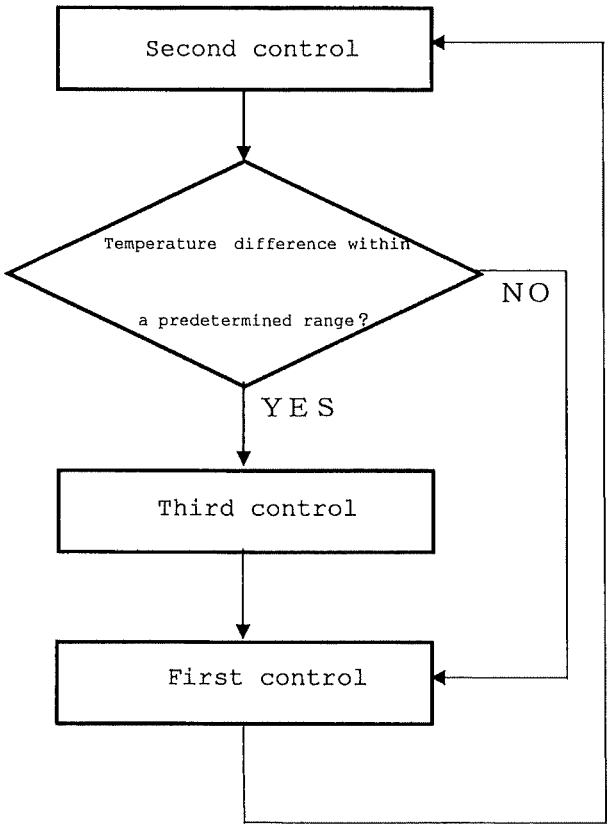

As shown in FIG. 4(A), FIG. 4(B) and FIG. 4(C), in the control of the second embodiment, on the premise that the first control and the second control are carried out, a third control is carried out by the control part 4.

Additionally, since the explanations of the first control and the second control are the same as those explained above, those explanations will be omitted.

As shown in FIG. 4(B), in the control of the second embodiment, with respect to air heater A1, air heater A2 and air heater A3 of the first air heater part 6*a* that have been brought into the ON state in the first control, determination is made as to whether or not the temperature difference is set within a predetermined range.

In this case, in the present specification, "the current temperature" means a temperature that is measured at the start time of the first control, and corresponds to an actual temperature at that time. That is, in the printing device 100, the current temperature is measured repeatedly at each cycle (twice as long as the fixed time T) when the first control is carried out.

Moreover, "the target temperature" means a target temperature preliminarily set. Additionally, the target temperature can be desirably set.

Furthermore, "the temperature difference" means a value obtained by subtracting the target temperature from the current temperature. That is, in the case of a positive value in the temperature difference, this means that the current temperature is higher than the target temperature, while in the case of a negative value in the temperature difference, this means that the current temperature is lower than the target temperature, and in the case when the temperature difference is 0, this means that the current temperature and the target temperature are the same.

Moreover, with respect to air heater A2 having a temperature difference within a predetermined range, the third control in which the OFF state is set prior to the passage of fixed time T is carried out.

Additionally, with respect to air heaters A1 and A3 not having a temperature difference within a predetermined range, the third control is not carried out.

Thereafter, air heater A1, air heater A2 and air heater A3 are set to the OFF state by the second control.

In this case, air heater B1, air heater B2 and air heater B3 that have been kept in the OFF state by the first control are maintained in the OFF state in the first control.

In the same manner, as shown in FIG. 4(C), in the control of the second embodiment, with respect to air heater B1, air heater B2 and air heater B3 of the second air heater part 6*b* that have been set to the ON state in the second control, determination is made as to whether or not a temperature difference is within a predetermined range.

At this time, with respect to air heater B3 having a temperature difference within the predetermined range, the third control in which the OFF state is set prior to the passage of fixed time T is carried out.

Additionally, with respect to air heaters B1 and B2 not having a temperature difference within a predetermined range, the third control is not carried out.

Thereafter, air heater B1, air heater B2 and air heater B3 are set to the OFF state by the first control.

In this case, air heater A1, air heater A2 and air heater A3 that have been kept in the OFF state by the second control are maintained in the OFF state in the second control.

Here, in the third control, explanation will be given on the temperature difference and time during which heating is continued (timing of turning OFF).

First, in the present specification, supposing that continuous heating for the fixed time T is 100% duty cycle, heating in the middle is indicated by the ratio of duty cycle. In other words, in the case of 50% duty cycle, heating time is represented by 0.5T, that is, a value obtained by multiplying the fixed time T by 50% (0.5).

In the case when in the third control, the current temperature of an air heater to be turned ON is the same as the target temperature, after having carried out a heating process at an updated duty cycle updated to X1% duty cycle, the corresponding air heater is brought into the OFF state.

Moreover, in the case when the current temperature of an air heater to be turned ON is higher than the target temperature, after having carried out a heating process at an updated duty cycle updated to X2% duty cycle, the corresponding air heater is brought into the OFF state.

Furthermore, in the case when the current temperature of an air heater to be turned ON is lower than the target temperature, after having carried out a heating process at an updated duty cycle updated to X3% duty cycle, the corresponding air heater is brought into the OFF state.

In this case, the timing at which each of these heating processes is started corresponds to the switching time of the first control or the second control.

Moreover, X1, X2 and X3 satisfy a relational expression: $X2<X1<X3$.

Additionally, X2 is greater than 0, and X3 does not exceed 100.

That is, since X2% duty cycle has a value smaller than the value of X1% duty cycle, the heating process is carried out for a shorter period of time. Moreover, since X3% duty cycle has a value greater than the value of X1% duty cycle, the heating process is carried out for a longer period of time.

More specifically, X1 is preferably set in a range from 20 to 30. In other words, X1% duty cycle is preferably set in a range from 20% to 30% duty cycle. Additionally, these numeric values can be desirably set by using parameters that fluctuate depending on conditions.

For example, in the case when X1 is set to 26, X2 becomes a value that is larger than 0 and smaller than 26, and X3 becomes a value that is greater than 26 and smaller than 100.

In the case when the current temperature is higher than the target temperature, it is more preferable to carry out the control process by further finely dividing X2% duty cycle.

In the case when the temperature difference of an air heater to be turned ON is greater than 0° C. and less than 4° C., after having carried out a heating process at an updated duty cycle updated to X4% duty cycle, the corresponding air heater is brought into the OFF state, and in the case when the temperature difference of an air heater to be turned ON is 4° C. or more, after having carried out a heating process at an updated duty cycle updated to X5% duty cycle, the corresponding air heater is preferably brought into the OFF state.

Moreover, X1, X4 and X5 satisfy a relational expression: $X5<X4<X1$.

Additionally, X5 is greater than 0.

That is, since X4% duty cycle has a value smaller than the value of X1% duty cycle, the heating process is carried out for a shorter period of time. Moreover, since X5% duty cycle has a value smaller than the value of X4% duty cycle, the heating process is carried out for a further shorter period of time.

More specifically, the border between X4 and X5 is preferably set to 12 to 13. In other words, the border between X4 and X5 is preferably set from 12% duty cycle to 13% duty cycle. Additionally, the numeric value of the border between X4 and X5 can be desirably set by using parameters that fluctuate depending on conditions.

For example, in the case when X1 is set to 26, and the border between X4 and X5 is set to 12.5, X4 becomes a value greater than 12.5 and smaller than 26, and X5 becomes a value that is greater than 0 and is 12.5 or less.

In this manner, in the printing device 100, on the premise that the first control and the second control are carried out, the control part 4 carries out the third control so that since excessive heating time can be cut, it is possible to provide superior energy efficiency.

Moreover, since the duty cycle is altered depending on a temperature difference from the target temperature, it is possible to suppress fluctuations in the air temperature to the minimum level.

Control of Third Embodiment: In the Case of Carrying Out First Control, Second Control, Third Control and Fourth Control FIG. 5(A) is an explanatory view for explaining a case in which a first control, a second control, a third control and a fourth control are carried out by a control part in a printing device in accordance with the present embodiment, and FIG. 5(B) is a flow chart showing the case in which the first control, the second control, the third control and the fourth control are carried out on a first air heater part by the control part in the printing device in accordance with the present embodiment, and FIG. 5(C) is a flow chart showing the case in which the first control, the second control, the third control and the fourth control are carried out on a second heater part by the control part in the printing device in accordance with the present embodiment.

Figure 5:
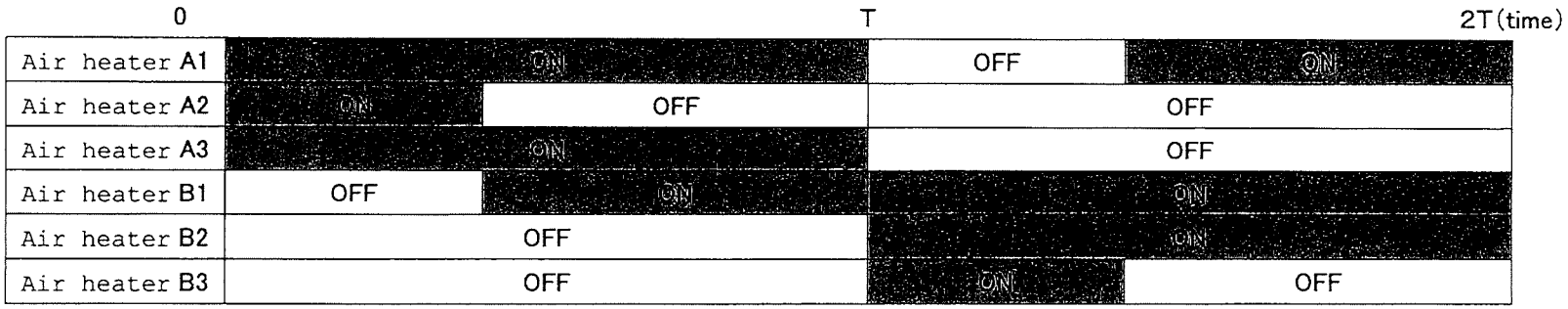
FIG. 5(A) is an explanatory view that explains a case in which the first control, the second control, the third control and a fourth control are carried out by the control part in the printing device in accordance with the present embodiment.
FIG. 5(B) is a flow chart in a case in which the first control, the second control, the third control and a fourth control of the first air heater are carried out by the control part in the printing device in accordance with the present embodiment.
FIG. 5(C) is a flow chart in a case in which the first control, the second control, the third control and a fourth control of the first air heater are carried out by the control part in the printing device in accordance with the present embodiment.
Figure 5:
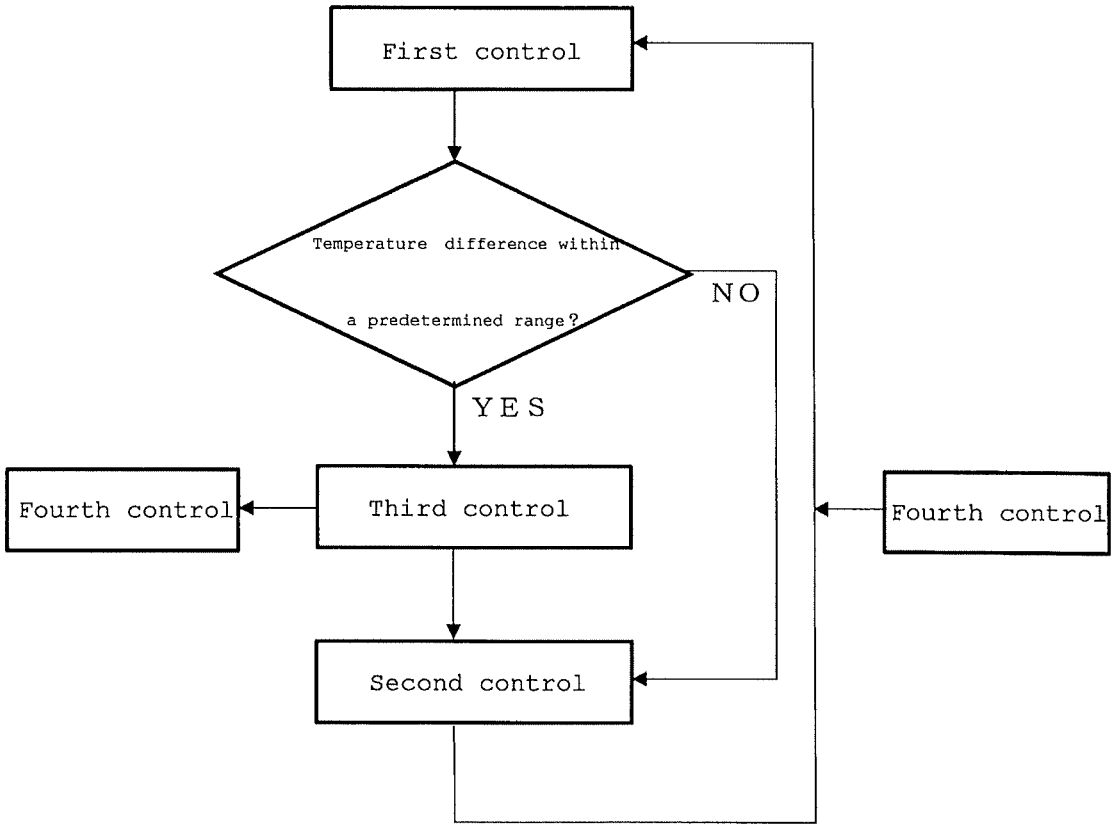
Figure 5:
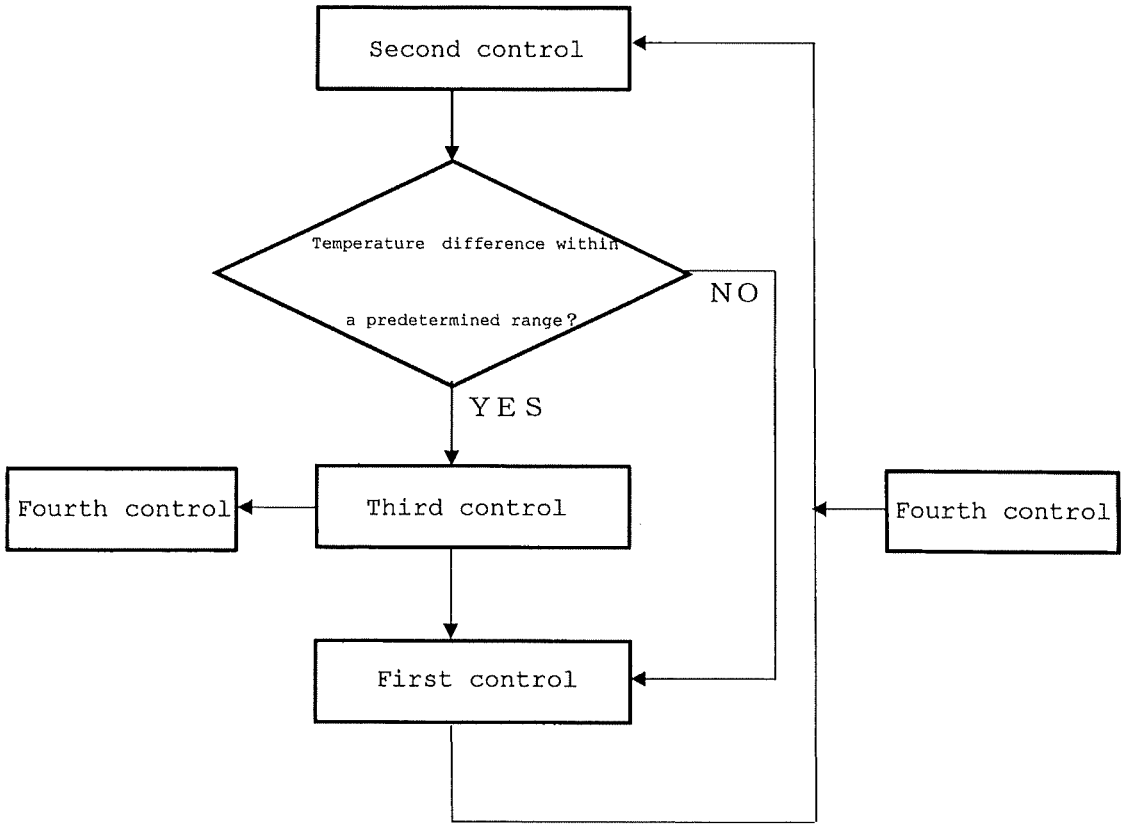

As shown in FIG. 5(A), FIG. 5(B) and FIG. 5(C), in the control of the third embodiment, on the premise that the first control, the second control and the third control are carried out, a fourth control is carried out by the control part 4.

Additionally, since the explanations of the first control, the second control and the third control are the same as those explained above, those explanations will be omitted.

Moreover, since the fourth control is carried out substantially at the same time as the third control, the explanation of its flow chart will be omitted.

As shown in FIG. 5(B), in the fourth control of the third embodiment, from air heater A2 of the first air heater part that has been heated at updated duty cycle by the third control, a distributed duty cycle, which corresponds to the rest of the time obtained by subtracting the corresponding update duty cycle from 100% duty cycle, is taken out.

Moreover, as shown in FIG. 5(C), the distributed duty cycle thus taken out is allocated to air heater B1 of the second air heater part that is in the OFF state by the first control so that the corresponding air heater B1 is heated (see FIG. 5(A)).

Additionally, in the case when there is no air heater set in the OFF state by the third control, the fourth control is not carried out.

In the same manner, as shown in FIG. 5(C), in the fourth control in the control of the third embodiment, from air heater B3 of the second air heater part that has been heated at updated duty cycle by the third control, a distributed duty cycle, which corresponds to the rest of the time obtained by subtracting the corresponding update duty cycle from 100% duty cycle, is taken out.

Moreover, as shown in FIG. 5(B), the distributed duty cycle thus taken out is allocated to air heater A1 of the first air heater part that is in the OFF state by the second control so that the corresponding air heater A1 is heated (see FIG. 5(A)).

In this case, in the fourth control, among air heaters that have been brought into the OFF state by the third control, the distributed duty cycle is desirably allocated to those air heaters having a temperature difference of −3° C. or less. That is, the distributed duty cycle is desirably allocated to those air heaters having the current temperature that is lower than the target temperature by 3° C. or more. In this case, the fourth control is not carried out on those air heaters having the temperature difference greater than −3° C. Thus, it becomes possible to suppress the corresponding heater from having a temperature overshoot.

Moreover, of those air heaters set in the OFF state by the third control, in the ascending order from the air heater having the lowest current temperature, those distributed duty cycle having greater values are desirably allocated.

That is, to the air heater having the lowest current temperature, the greatest distributed duty cycle is desirably allocated, and to the air heater having the current temperature that is not the lowest, the smallest distributed duty cycle is desirably allocated. In this case, the temperature difference can be made smaller efficiently among the mutual air heaters in a short period of time.

In this manner, in the printing device 100, on the premise that the first control, the second control and the third control are carried out, the control part 4 carries out the fourth control so that it becomes possible to provide superior energy efficiency and also to allow the respective air heaters to reach the target temperature more quickly.

Moreover, the temperature difference among the mutual air heaters can be minimized as small as possible.

Furthermore, since the duty cycle is altered depending on the temperature difference from the target temperature, it is possible to suppress fluctuations in the air temperature to the minimum level.

As described above, explanation has been given specifically on desired embodiments of the present invention; however, the present invention is not intended to be limited by the above-mentioned embodiments.

In the printing device 100 in accordance with the present embodiment, the ink-jet printing device for applying ink in the ink-jet system is used; however, an offset printing device, a gravure printing device, a flexo printing device, a screen printing device, etc. may also be used.

Moreover, in the case of using the ink-jet printing device, not limited by the line head system, the printing part 5 of a serial head system may be used.

The printing device 100 in accordance with the present embodiment is provided with the first air heater part 6*a* and the second air heater part 6*b*, each constituted by a plurality of air heaters; however, the number of the air heater parts is not particularly limited.

Moreover, each of the first air heater part 6*a* and the second air heater part 6*b* includes 18 units of air heaters 6; however, the number of the air heaters is not particularly limited.

In the printing device 100 in accordance with the present embodiment, the drum 3 is prepared as a heating drum the surface of which can be heated; however, this heating process is not particularly required. That is, a simple guide roller may be used.

In the printing device 100 in accordance with the present embodiment, the fourth control by the control part 4 is desirably carried out on an air heater having a temperature difference of −3° C. or less; however, the temperature difference is not particularly limited by −3° C., and may be desirably set.

INDUSTRIAL APPLICABILITY

The present invention is utilized as a printing device for carrying out a printing process on the printing medium 1.

In accordance with the printing device 100 of the present invention, the temperature adjustment of air can be carried out more simply, and it becomes possible to provide superior energy efficiency.

REFERENCE SIGNS LIST

1 . . . printing medium,
1*a* . . . printed medium,
100 . . . printing device,
2 . . . guide roller,
3 . . . drum,
4 . . . control part,
5 . . . printing part,
6, A1, A2, A3, B1, B2, B3 . . . air heater,
61 . . . heater part,
62 . . . nozzle part,
63 . . . housing part,
63*a* . . . heater cover,
63*b* . . . bottom plate,
65 . . . temperature detection part,
6*a* . . . first air heater part,
6*b* . . . second air heater part,
N . . . nozzle hole,
R . . . heat radiating part,
S . . . slit

The invention claimed is:

1. A printing device comprising:

a printing part for printing ink on a printing medium, a first air heater part and a second air heater part for heating and drying the printing medium on which the ink is printed, and a control part that ON/OFF controls heating of the first air heater part and the second air heater part, wherein each of the first air heater part and the second air heater part comprises at least one or more air heaters and the control part includes a first control in which the first air heater part is turned ON, while the second air heater part is simultaneously turned OFF, and a second control in which the first air heater part is turned OFF, while the second air heater part is simultaneously turned ON, with the first control and the second control being alternately switched in each fixed period, each of the air heaters being provided with a temperature detection part for measuring a current temperature at a time of starting the first control, and based upon a temperature difference obtained by subtracting a target temperature from the current temperature of the air heater to be turned ON, a third control for turning OFF the corresponding air heater prior to the passage of the fixed period of time is further carried out, wherein supposing that continuously heating for the fixed period of time is 100% duty cycle, in the case when the current temperature of the air heater to be turned ON in the third control is the same as the target temperature, after carrying out a heating process in an updated duty cycle updated to X1% duty cycle, the corresponding air heater is turned OFF, in the case when the current temperature of the air heater to be turned ON is higher than the target temperature, after carrying out a heating process in an updated duty cycle updated to X2% duty cycle, the corresponding air heater is turned OFF, and in the case when the current temperature of the air heater to be turned ON is lower than the target temperature, after carrying out a heating process in an updated duty cycle updated to X3% duty cycle, the corresponding air heater is turned OFF, and wherein said X1 is set to 20 to 30, and said X1, X2 and X3 satisfy a relational expression: X2<X1<X3.

2. The printing device according to claim 1, wherein in the case when the temperature difference of the air heater to be turned ON is greater than 0° C. and less than 4° C., after carrying out a heating process in an updated duty cycle updated to X4% duty cycle, the corresponding air heater is set to an OFF state, and in the case when the temperature difference of the air heater to be turned ON is 4° C. or more, after carrying out a heating process in an updated duty cycle updated to X5% duty cycle, the corresponding air heater is set to the OFF state, and wherein X1, X4 and X5 satisfy a relational expression: X5<X4<X1.

3. The printing device according to claim 1, wherein the control part carries out a fourth control in which by allocating a distributed duty cycle corresponding to the rest of time obtained by subtracting an updated duty cycle from 100% duty cycle to the air heater that is in the OFF state, the corresponding air heater is heated.

4. The printing device according to claim 3, wherein in the fourth control, said distributed duty cycle is allocated to the air heater having the temperature difference of −3° C. or less.

5. The printing device according to claim 3, wherein in the fourth control, larger distributed duty cycles are allocated to air heaters in an ascending order from the air heater having the lowest current temperature.

6. The printing device according to claim 4, wherein in the fourth control, larger distributed duty cycles are allocated to air heaters in the ascending order from the air heater having the lowest current temperature.

7. The printing device according to claim 2, wherein the control part carries out a fourth control in which by allocating a distributed duty cycle corresponding to the rest of time obtained by subtracting an updated duty cycle from 100% duty cycle to the air heater that is in the OFF state, the corresponding air heater is heated.

8. The printing device according to claim 7, wherein in the fourth control, said distributed duty cycle is allocated to the air heater having the temperature difference of −3° C. or less.

9. The printing device according to claim 7, wherein in the fourth control, larger distributed duty cycles are allocated to air heaters in the ascending order from the air heater having the lowest current temperature.

10. The printing device according to claim 8, wherein in the fourth control, larger distributed duty cycles are allocated to air heaters in the ascending order from the air heater having the lowest current temperature.

11. The printing device according to claim 1, wherein the air heater comprises a housing part having an opening part for use in blowing air, and a nozzle part and a heater part built into the housing part, wherein the nozzle part supplies air into the housing part, and the heater part heats air inside the housing part.

* * * * *